US010760573B2

(12) United States Patent
Müller et al.

(10) Patent No.: US 10,760,573 B2
(45) **Date of Patent: *Sep. 1, 2020**

(54) METHOD OF PUMPING IN A SYSTEM OF VACUUM PUMPS AND SYSTEM OF VACUUM PUMPS

(71) Applicant: Ateliers Busch SA, Chevenez (CH)

(72) Inventors: Didier Müller, Delémont (CH); Jean-Eric Larcher, Delle (FR); Théodore Iltchev, Grandvillars (FR)

(73) Assignee: Ateliers Busch SA, Chevenez (CH)

( * ) Notice: Subject to any disclaimer, the term of this patent is extended or adjusted under 35 U.S.C. 154(b) by 183 days.

This patent is subject to a terminal disclaimer.

(21) Appl. No.: 15/321,839

(22) PCT Filed: Jun. 27, 2014

(86) PCT No.: PCT/EP2014/063725
§ 371 (c)(1),
(2) Date: Dec. 23, 2016

(87) PCT Pub. No.: WO2015/197138
PCT Pub. Date: Dec. 30, 2015

(65) Prior Publication Data

US 2017/0122321 A1 May 4, 2017

(51) Int. Cl.
*F04C 14/22* (2006.01)
*F04C 14/28* (2006.01)
(Continued)

(52) U.S. Cl.
CPC ..... *F04C 28/24* (2013.01); *F04C 18/34* (2013.01); *F04C 18/344* (2013.01);
(Continued)

(58) Field of Classification Search
CPC ..... F04C 14/22; F04C 14/28; F04C 14/24; F04C 23/001; F04C 25/02; F04C 28/02
(Continued)

(56) References Cited

U.S. PATENT DOCUMENTS 3,536,418 A * 10/1970 Breaux ..... F04D 19/046 417/49
3,707,339 A * 12/1972 Budgen ..... F04C 28/28 418/13
(Continued)

FOREIGN PATENT DOCUMENTS

DE 3842886 A1 7/1989
DE 3819692 A1 * 12/1989 ..... F04C 23/001
(Continued)

OTHER PUBLICATIONS

International Search Report for PCT/EP2014/063725 dated Mar. 9, 2015, 11 pgs.
(Continued)

*Primary Examiner* — Deming Wan
(74) *Attorney, Agent, or Firm* — Praedeere Law

(57) ABSTRACT

The present invention relates to a pumping method in a pumping system (SP, SPP) comprising: a main lubricated rotary vane vacuum pump (3) with a gas inlet port (2) connected to a vacuum chamber (1) and a gas outlet port (4) leading into a conduit (5) before coming out into the gas outlet (8) of the pumping system (SP, SPP), a non-return valve (6) positioned in the conduit (5) between the gas outlet port (4) and the gas outlet (8), and an auxiliary lubricated rotary vane vacuum pump (7) connected in parallel to the non-return valve (6). According to this method, the main lubricated rotary vane vacuum pump (3) is activated in order to pump the gases contained in the vacuum chamber (1) through the gas outlet port (4), simultaneously the auxiliary lubricated rotary vane vacuum pump (7) is activated and continues to operate all the while that the main lubricated rotary vane vacuum pump (3) pumps the gases contained in the vacuum chamber (1) and/or all the while that the main lubricated rotary vane vacuum pump (3) maintains a defined
(Continued)

pressure in the vacuum chamber (1). The present invention also relates to a pumping system (SP, SPP) able to be used to implement this method.

9 Claims, 2 Drawing Sheets

(51) Int. Cl.

| | |
|---|---|
| ***F04C 14/24*** | (2006.01) |
| ***F04C 15/06*** | (2006.01) |
| ***F04C 23/00*** | (2006.01) |
| ***F04C 25/02*** | (2006.01) |
| ***F04C 28/02*** | (2006.01) |
| ***F04C 28/24*** | (2006.01) |
| ***F04C 18/344*** | (2006.01) |
| ***F04C 18/34*** | (2006.01) |
| ***F04C 29/00*** | (2006.01) |
| ***F04C 29/02*** | (2006.01) |
| ***F04C 29/12*** | (2006.01) |
| *F04C 28/06* | (2006.01) |

(52) U.S. Cl.
CPC ..... *F04C 23/001* (2013.01); *F04C 25/02* (2013.01); *F04C 28/02* (2013.01); *F04C 29/0085* (2013.01); *F04C 29/026* (2013.01); *F04C 29/126* (2013.01); *F04C 28/06* (2013.01); *F04C 2240/30* (2013.01); *F04C 2240/40* (2013.01); *F04C 2270/185* (2013.01)

(58) Field of Classification Search
USPC ..... 418/1, 2, 6, 10, 209, 5, 7, 11–13, 259
See application file for complete search history.

(56) References Cited

U.S. PATENT DOCUMENTS

| | | | | |
|---|---|---|---|---|
| 4,426,450 | A | 1/1984 | Donofrio | |
| 5,004,407 | A * | 4/1991 | Hutchison | F01D 25/20 184/6.23 |
| 5,697,771 | A * | 12/1997 | Arndt | F04C 23/001 418/15 |
| 6,123,516 | A * | 9/2000 | Burghard | F04B 25/00 417/250 |
| 6,589,023 | B2 | 7/2003 | Royce et al. | |
| 6,644,931 | B2 | 11/2003 | Puech | |
| 9,175,688 | B2 | 11/2015 | Neel | |
| 9,558,969 | B2 | 1/2017 | Seigeot | |
| 2002/0131870 | A1 | 9/2002 | Puech | |
| 2003/0068233 | A1 * | 4/2003 | Royce | F04B 37/14 417/251 |
| 2004/0173312 | A1 * | 9/2004 | Shibayama | F04C 23/001 156/345.29 |
| 2004/0261792 | A1 | 12/2004 | Wolf et al. | |
| 2005/0268644 | A1 | 12/2005 | Oshitani et al. | |
| 2006/0086649 | A1 | 4/2006 | Wieczorek et al. | |
| 2006/0182638 | A1 | 8/2006 | Ohmi | |
| 2007/0286749 | A1 * | 12/2007 | Wagner | F04C 29/0064 417/410.1 |
| 2008/0145209 | A1 * | 6/2008 | Wagner | F04C 11/001 415/175 |
| 2008/0145238 | A1 | 6/2008 | Shibayama et al. | |
| 2008/0166247 | A1 | 7/2008 | Holzemer | |
| 2009/0112370 | A1 | 4/2009 | Tanaka et al. | |
| 2009/0246040 | A1 * | 10/2009 | Tanigawa | F04C 23/001 417/252 |
| 2011/0164992 | A1 | 7/2011 | Shibayama et al. | |
| 2011/0263406 | A1 | 10/2011 | Naegelen et al. | |
| 2012/0080134 | A1 | 4/2012 | Harris et al. | |
| 2012/0219443 | A1 | 8/2012 | Neel | |
| 2015/0170938 | A1 | 6/2015 | Seigeot | |
| 2015/0308461 | A1 | 10/2015 | Tell | |
| 2015/0345496 | A1 * | 12/2015 | Cadeddu | F04C 29/028 418/1 |

FOREIGN PATENT DOCUMENTS

| | | | |
|---|---|---|---|
| DE | 8816875 | U1 | 4/1991 |
| DE | 102012220442 | A1 | 5/2014 |
| EP | 1243795 | A1 | 9/2002 |
| FR | 2952683 | A1 | 5/2011 |
| JP | 2007100562 | A | 4/2007 |
| WO | WO2014012896 | A2 | 1/2014 |

OTHER PUBLICATIONS

International Search Report and Written Opinion for PCT/EP2014/071197, dated Mar. 9, 2015, 12 pages.
International Search Report and Written Opinion for PCT/EP2014/070691, dated Mar. 11, 2015, 12 pages.
International Search Report for PCT/EP2014/058948, dated May 28, 2014, 4 pages.
Non-Final Office Action issued in U.S. Appl. No. 15/513,574, dated Aug. 15, 2019.
Final Office Action issued in U.S. Appl. No. 15/513,574, dated Dec. 12, 2019.
Non-Final Office Action issued in U.S. Appl. No. 15/512,883, dated Feb. 25, 2019.
Final Office Action issued in U.S. Appl. No. 15/512,883, dated Jul. 11, 2019.
Non-Final Office Action issued in U.S. Appl. No. 15/306,175, dated Jun. 29, 2018.
Final Office Action issued in U.S. Appl. No. 15/306,175, dated Jan. 24, 2019.

* cited by examiner

METHOD OF PUMPING IN A SYSTEM OF VACUUM PUMPS AND SYSTEM OF VACUUM PUMPS

TECHNICAL FIELD OF THE INVENTION

The present invention relates to a pumping method making it possible to reduce the consumption of electrical energy as well as increase the performance in terms of flow rate and final vacuum in a pumping system in which the main pump is a lubricated rotary vane vacuum pump. The invention likewise relates to a system of vacuum pumps which can be used to achieve the method according to the present invention.

PRIOR ART

The general tendencies to increase the performance of vacuum pumps, to reduce the costs of installations and the consumption of energy in industries have brought significant developments in terms of performance, energy economy, bulkiness, in the drives, etc.

The state of the art shows that to improve the final vacuum and to reduce the consumption of energy supplementary stages must be added in vacuum pumps of the multi-stage Roots or multi-stage claw type. For screw vacuum pumps there must be additional turns of the screw and/or the rate of internal compression must be increased. For lubricated rotary vane vacuum pumps typically one or more supplementary stages must also be added in series in order to increase the rate of internal compression.

The state of the art concerning the systems of vacuum pumps which aim to improve the final vacuum and to increase the flow rate show booster pumps of Roots type arranged upstream from main lubricated rotary vane pumps. This type of systems is bulky, operates either with by-pass valves presenting problems of reliability or by employing means of measurement, control, adjustment or servo-control. However, these means of control, adjustment or servo-control must be controlled in an active way, which necessarily results in an increase in the number of components of the system, its complexity and its cost.

SUMMARY OF INVENTION

The present invention has as object to propose a pumping method in a system of vacuum pumps making it possible to reduce the electrical energy necessary for putting a chamber under vacuum and for maintaining it, as well as to reduce the temperature of the exit gas.

The present invention also has as object to propose a pumping method in a system of vacuum pumps making it possible to obtain a higher flow rate at low pressure than that which can be obtained with the aid of a single lubricated rotary vane vacuum pump during the pumping of a vacuum chamber.

The present invention likewise has as object to propose a pumping method in a system of vacuum pumps making it possible to obtain a better vacuum than that which can be obtained with the aid of a single lubricated rotary vane vacuum pump during the pumping of a vacuum chamber.

These objects of the present invention are attained with the aid of a pumping method which is achieved within the framework of a system of vacuum pumps, the configuration of which consists essentially of a main lubricated rotary vane vacuum pump equipped with a gas inlet port connected to a vacuum chamber and with a gas outlet port leading into a conduit which is equipped with a non-return valve before coming out into the atmosphere or into other apparatuses. The suction end of an auxiliary lubricated rotary vane vacuum pump is connected in parallel to this non-return valve, its exit going into the atmosphere or rejoining the conduit of the main pump after the non-return valve.

Such a pumping method is in particular the subject matter of the independent claim 1. Different preferred embodiments of the invention are moreover the subject matter of the dependent claims.

The method according to the present invention thus consists essentially of making an auxiliary lubricated rotary vane vacuum pump operate continuously all the while that the main lubricated rotary vane vacuum pump pumps the gases contained in the vacuum chamber through the gas inlet port, but also all the while that the main lubricated rotary vane vacuum pump maintains a defined pressure (for example the final vacuum) in the chamber by discharging the gases rising through its outlet.

According to a first aspect, the invention resides in the fact that the coupling of the main lubricated rotary vane vacuum pump and of the auxiliary lubricated rotary vane vacuum pump does not require measurements and specific devices (for example sensors for pressure, temperature, current, etc.), servo-controls or data management and calculation. Consequently, the pumping system suitable for implementing the pumping method according to the present invention comprises a minimal number of components, has great simplicity and is far less expensive than the existing systems.

According to a second variant of the method of the present invention, to meet specific requirements, the start-up of the auxiliary lubricated rotary vane vacuum pump is controlled in an "all or nothing" way. The controlling consists in checking one or more parameters and following certain rules in putting into operation the auxiliary lubricated rotary vane vacuum pump or stopping it, depending upon certain predefined rules. The parameters, provided by suitable sensors, are, for example, the motor current of the main lubricated rotary vane vacuum pump, the temperature or the pressure of the gases in the space of the exit conduit of the main lubricated rotary vane vacuum pump, limited by the non-return valve, or a combination of these parameters.

The dimensioning of the auxiliary lubricated rotary vane vacuum pump is determined by the minimal consumption of energy of its motor. It is normally single-staged. Its nominal flow rate is selected as a function of the flow rate of the main lubricated rotary vane vacuum pump but also by taking into account the size of the space of the exit conduit of the main lubricated rotary vane vacuum pump, limited by the non-return valve. This flow rate can be 1/500 to 1/5 of the nominal flow rate of the main lubricated rotary vane vacuum pump, but can also be less or greater than these values.

The non-return valve, placed in the conduit at the outlet of the main lubricated rotary vane vacuum pump, can be a commercially available standard element. It is dimensioned according to the nominal flow rate of the main lubricated rotary vane vacuum pump. In particular, it is foreseen that the non-return valve closes when the pressure at the suction end of the main lubricated rotary vane vacuum pump is between 500 mbar absolute and the final vacuum (for example 400 mbar).

According to another variant, the main lubricated rotary vane vacuum pump is multi-staged.

According to another variant, the auxiliary lubricated rotary vane vacuum pump is multi-staged.

The auxiliary lubricated rotary vane vacuum pump is preferably of small size.

According to another variant, the auxiliary lubricated rotary vane vacuum pump discharges the gases into the oil separator of the main lubricated rotary vane vacuum pump.

According to still another variant, the auxiliary lubricated rotary vane vacuum pump is integrated in the oil separator of the main lubricated rotary vane vacuum pump.

Starting with a cycle of evacuation of the chamber, the pressure there is elevated, for example equal to the atmospheric pressure. Given the compression in the main lubricated rotary vane vacuum pump, the pressure of the gases discharged at its outlet is higher than the atmospheric pressure (if the gases at the outlet of the main pump are discharged directly into the atmosphere) or higher than the pressure at the inlet of another apparatus connected downstream. This causes the opening of the non-return valve.

When this non-return valve is open, the action of the auxiliary lubricated rotary vane vacuum pump on the parameters of operation of the main lubricated rotary vane vacuum pump is felt very slightly. In contrast, when the non-return valve closes at a certain pressure (because the pressure in the chamber has dropped in the meantime), the action of the auxiliary lubricated rotary vane vacuum pump brings about a progressive reduction of the difference in pressure between the chamber and the conduit after the valve. The pressure at the outlet of the main lubricated rotary vane vacuum pump becomes that at the inlet of the small auxiliary lubricated rotary vane vacuum pump, that at its outlet being always the pressure in the conduit after the non-return valve. The more the auxiliary lubricated rotary vane vacuum pump pumps, the more the pressure drops at the outlet of the main lubricated rotary vane vacuum pump, in the closed space, limited by the non-return valve, and consequently the difference in pressure between the chamber and the outlet of the main lubricated rotary vane vacuum pump decreases.

This difference makes the internal leaks more minimal in the main lubricated rotary vane vacuum pump and causes a bigger reduction of the pressure in the chamber, which improves the final vacuum. In addition, the main lubricated rotary vane vacuum pump consumes less and less energy for the compression and produces less and less compression heat.

In the case of controlling of the auxiliary lubricated rotary vane vacuum pump, there exists an initial position for start-up of the pumping system when the sensors are in a defined state or give initial values. As the main lubricated rotary vane vacuum pump pumps the gases of the vacuum chamber, the parameters such as the current of its motor, the temperature and the pressure of the gases in the space of the exit conduit begin to change and reach threshold values detected by the sensors. This causes the switching on of the small auxiliary lubricated rotary vane vacuum pump. When these parameters return to the initial ranges (outside the set values) with a time lag, the auxiliary lubricated rotary vane vacuum pump is stopped.

On the other hand, it is also evident that the study of the mechanical concept seeks to reduce the space between the gas outlet port of the main lubricated rotary vane vacuum pump and the non-return valve with the aim of being able to reduce the pressure there more quickly.

BRIEF DESCRIPTION OF DRAWINGS

The features and the advantages of the present invention will appear with more details within the context of the description which follows with example embodiments given by way of illustration and in a non-limiting way with reference to the attached drawings.

DETAILED DESCRIPTION OF EMBODIMENTS OF THE INVENTION

Figure 1:
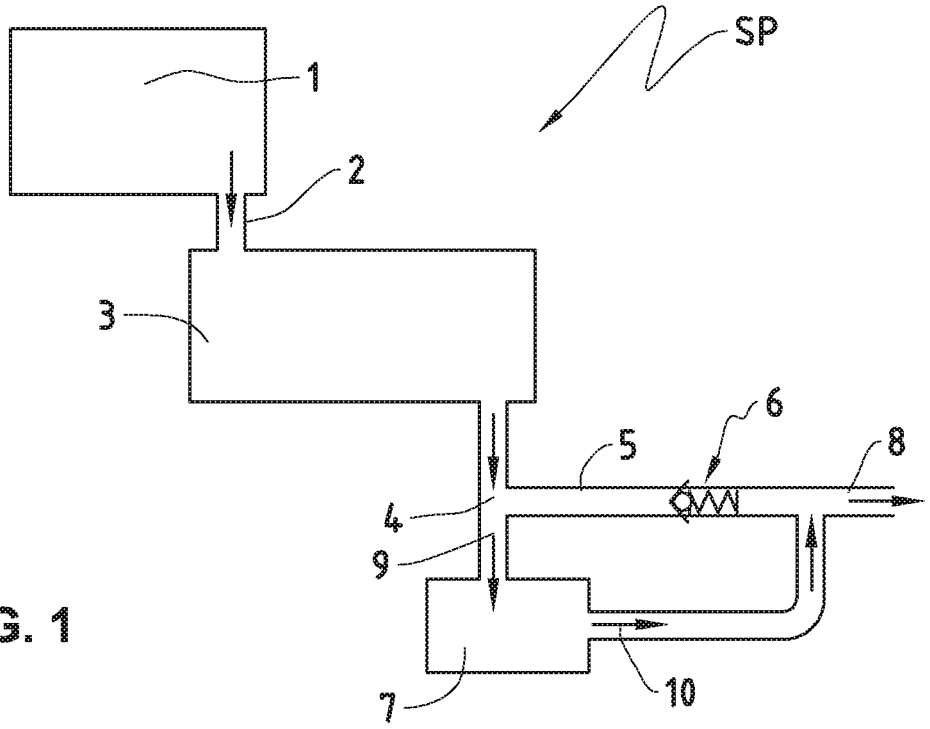
FIG. 1 represents in a diagrammatic way a system of vacuum pumps suitable for implementation of a pumping method according to a first embodiment of the present invention.

FIG. 1 represents a pumping system SP suitable for implementing a pumping method according to a first embodiment of the present invention.

This system of vacuum pumps SP comprises a chamber 1, which is connected to the suction port 2 of a main lubricated rotary vane vacuum pump 3. The gas outlet port of the main lubricated rotary vane vacuum pump 3 is connected to a conduit 5. A non-return discharge valve 6 is placed in the conduit 5, which after this non-return valve continues into a gas exit conduit 8. The non-return valve 6, when it is closed, allows the formation of a space 4, contained between the gas outlet port of the main vacuum pump 3 and itself.

The system of vacuum pumps SP also comprises an auxiliary lubricated rotary vane vacuum pump 7, connected in parallel to the non-return valve 6. The suction port 9 of the auxiliary lubricated rotary vane vacuum pump 7 is connected to the space 4 of the conduit 5, and its discharge port 10 is connected to the conduit 8.

From the start of the main lubricated rotary vane vacuum pump 3, the auxiliary lubricated rotary vane vacuum pump 7 is also started up. The main lubricated rotary vane vacuum pump 3 suctions the gases in the chamber 1 through the port 2 connected at its inlet and compresses them to discharge them afterwards at its outlet in the conduit 5 and then through the non-return valve 6. When the closure pressure for the non-return valve 6 is reached, it closes. Starting from this moment the pumping of the auxiliary lubricated rotary vane vacuum pump 7 makes the pressure in the space 4 decrease progressively to its limit pressure. In parallel, the power consumed by the main lubricated rotary vane vacuum pump 3 decreases progressively. This takes place in a short time period, for example for a certain cycle in 5 to 10 seconds.

With a clever adjustment of the flow rate of the auxiliary lubricated rotary vane vacuum pump 7 and of the closure pressure of the non-return valve 6 as a function of the flow rate of the main lubricated rotary vane vacuum pump 3 and the space of the chamber 1, it is moreover possible to reduce the time before the closure of the non-return valve 6 with respect to the duration of the evacuation cycle and thus reduce the electrical energy of the motor of the auxiliary lubricated rotary vane vacuum pump 7 during the time before the closure of the non-return valve 6. On the other hand, the advantage of simplicity gives an excellent reliability to the system as well as a lower price in comparison with similar pumps equipped with programmable automatic control and/or speed controller, controlled valves, sensors, etc.

Figure 2:
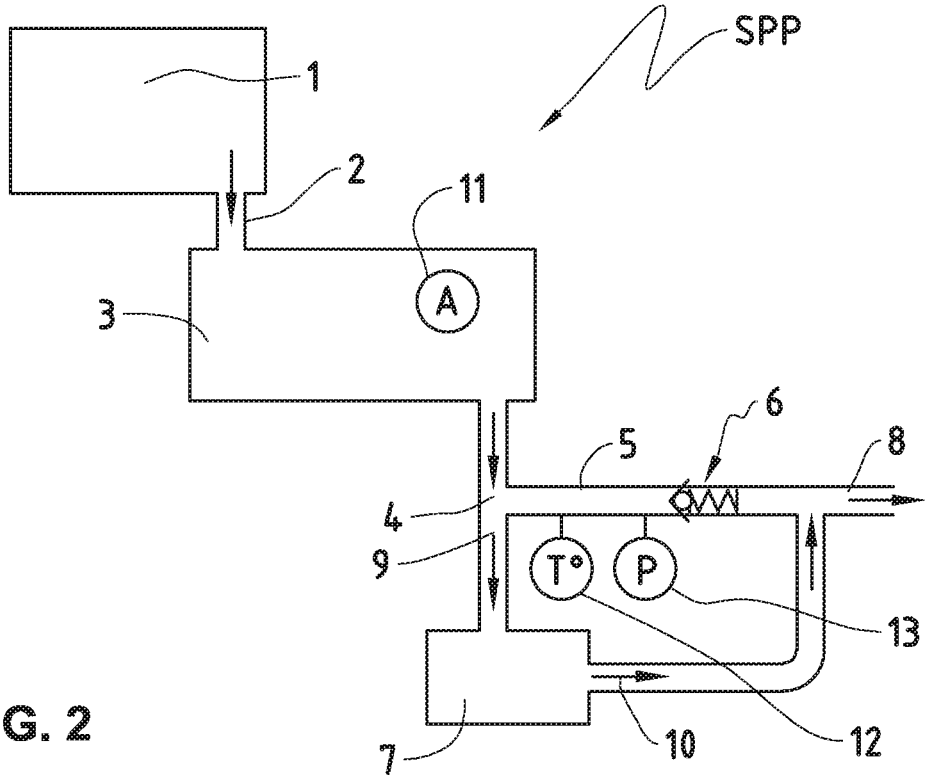
FIG. 2 represents in a diagrammatic way a system of vacuum pumps suitable for implementation of a pumping method according to a second embodiment of the present invention.

FIG. 2 represents a system of vacuum pumps SP suitable for implementation of a pumping method according to a second embodiment of the present invention.

With respect to the system shown in FIG. 1, the system represented in FIG. 2 represents the "controlled" pumping system SPP, which further comprises suitable sensors 11, 12, 13 which control either the motor current (sensor 11) of the main lubricated rotary vane vacuum pump 3, or the pressure (sensor 13) of the gases in the space of the exit conduit of the main lubricated rotary vane vacuum pump, limited by the non-return valve 6, or the temperature (sensor 12) of the gases in the space of the exit conduit of the main lubricated rotary vane vacuum pump, limited by the non-return valve 6, or a combination of these parameters.

Figure 3:
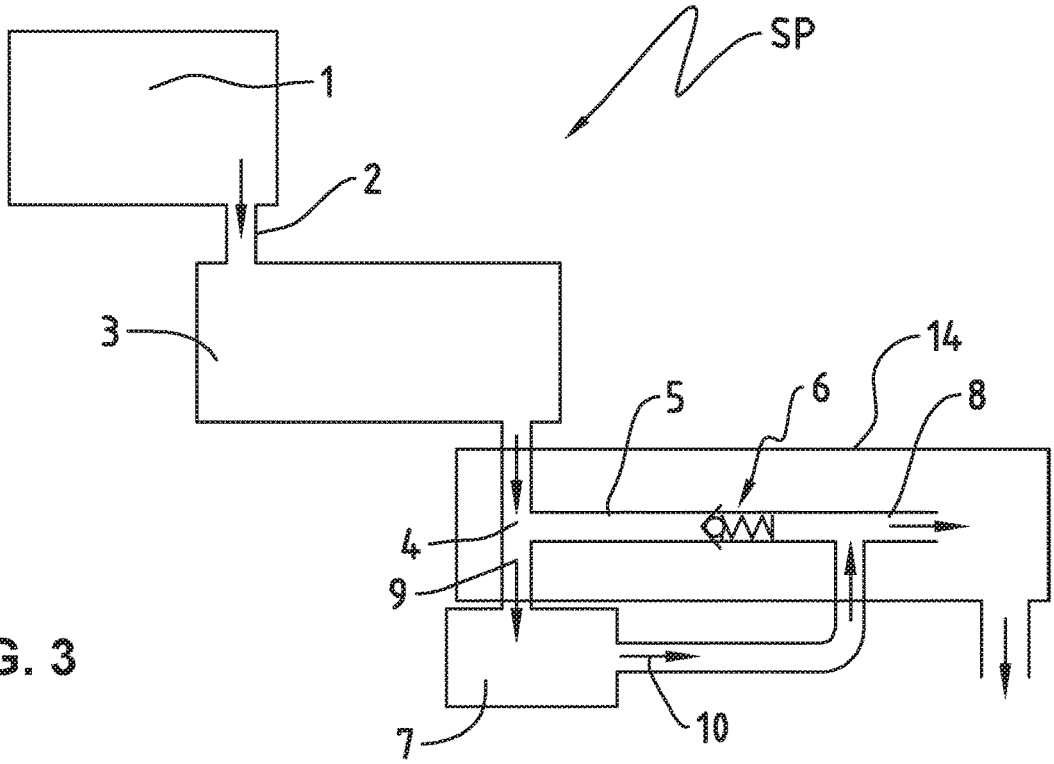
FIG. 3 represents in a diagrammatic way the system of vacuum pumps according to the first embodiment, showing the feature wherein an auxiliary lubricated rotary vane vacuum pump ejects gas into an oil separator of a main lubricated rotary vane vacuum pump.
Figure 4:
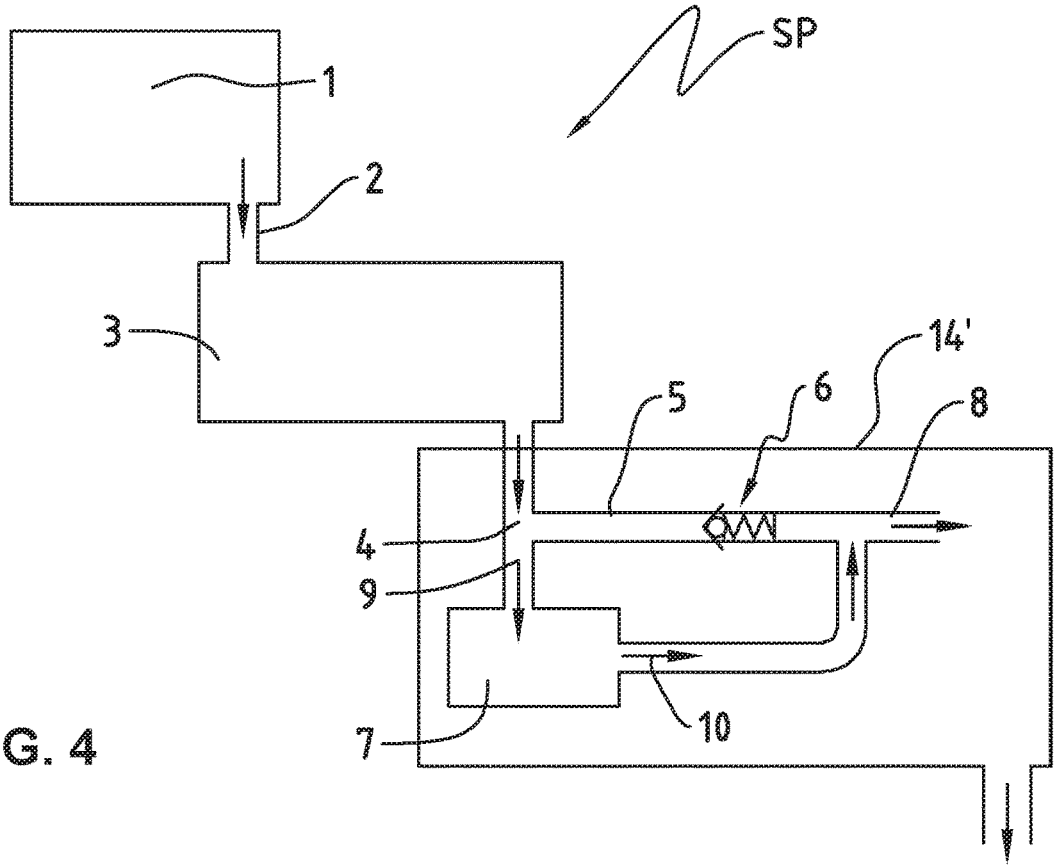
FIG. 4 represents in a diagrammatic way the system of vacuum pumps according to the second embodiment, showing the feature wherein an auxiliary lubricated rotary vane vacuum pump is incorporated in an oil separator of a main lubricated rotary vane vacuum pump.

As shown in FIG. 3 the auxiliary lubricated rotary vane vacuum pump 7 ejects the gas into an oil separator 14 of the main lubricated rotary vane vacuum pump 3. As shown in FIG. 4 the auxiliary lubricated rotary vane vacuum pump 7 is incorporated in an oil separator 14' of the main lubricated rotary vane vacuum pump 3.

In effect, when the main lubricated rotary vane vacuum pump 3 starts to pump the gases of the vacuum chamber 1, the parameters, such as the current of its motor, the temperature and the pressure of the gases in the space of the exit conduit 4, begin to change and reach threshold values detected by the sensors. For the current of the motor, the threshold value can be a percentage of the maximum value measured during an evacuation cycle without activation of the auxiliary vacuum pump (for example 75%). For the temperature of the gases, measured at a place well defined in the space of the exit conduit 4, the threshold value can be a percentage (for example 80%) of the maximum value measured during an evacuation cycle without activation of the auxiliary vacuum pump. For the pressure of the gases, the threshold value (for example 100 mbar) is defined as a function in relation to the flow rates of the two pumps, the main one and the auxiliary one. After suitable time lags, specific to each parameter, the activation of the auxiliary lubricated rotary vane vacuum pump 7 is triggered. When these parameters return to the initial ranges (outside the set values), with suitable time lags, specific to each parameter, the auxiliary lubricated rotary vane vacuum pump 7 is stopped.

Certainly the present invention is subject to numerous variations regarding its implementation. Although diverse embodiments have been described, it is well understood that it is not conceivable to identify in an exhaustive way all the possible embodiments. Of course replacing a described means with an equivalent means can be envisaged without departing from the scope of the present invention. All these modifications form part of the common knowledge of one skilled in the art in the field of vacuum technology.

The invention claimed is:

1. A pumping method in a system of vacuum pumps comprising:

providing a main vacuum pump with a gas inlet port connected to a vacuum chamber and a gas outlet port leading into a conduit before coming out into a gas outlet of the system of vacuum pumps, said main vacuum pump including a motor;

providing a non-return valve in the conduit between said gas outlet port and said gas outlet of the system of vacuum pumps; and providing an auxiliary vacuum pump connected in parallel to said non-return valve;

activating said main vacuum pump in order to pump gases contained in the vacuum chamber through said gas outlet port and simultaneously activating said auxiliary vacuum pump; and continuing to operate said auxiliary vacuum pump all the while that said main vacuum pump pumps the gases contained in the vacuum chamber and/or all the while that said main vacuum pump maintains a defined pressure in the vacuum chamber.

2. The pumping method according to claim 1, comprising providing an outlet of said auxiliary vacuum pump that rejoins said gas outlet of the system of vacuum pumps after said non-return valve.

3. The pumping method according to claim 1, comprising providing said auxiliary vacuum pump with a nominal flow rate selected as a function of a volume of said conduit which is limited by said non-return valve.

4. The pumping method according to claim 3, comprising providing said auxiliary vacuum pump with the flow rate that is from 1/500 to 1/5 of a nominal flow rate of said main vacuum pump.

5. The pumping method according to claim 1, comprising providing said auxiliary vacuum pump as single-staged or multi-staged.

6. The pumping method according to claim 1, comprising closing said non-return valve when a pressure at a suction end of said main vacuum pump is between 500 mbar absolute and a final vacuum.

7. The pumping method according to claim 1, wherein each of said main vacuum pump and said auxiliary vacuum pump is a lubricated rotary vane vacuum pump, comprising providing said main lubricated rotary vane vacuum pump with an oil separator, and said auxiliary lubricated rotary vane vacuum pump discharging the gases into said oil separator.

8. The pumping method according to claim 1, wherein each of said main vacuum pump and said auxiliary vacuum pump is a lubricated rotary vane vacuum pump, comprising providing said main lubricated rotary vane vacuum pump with an oil separator, and said auxiliary lubricated rotary vane vacuum pump being integrated in said oil separator.

9. The pumping method according to claim 1 comprising continuing to operate said auxiliary vacuum pump all the while that said main vacuum pump pumps the gases contained in the vacuum chamber.

* * * * *